US012691358B2

(12) United States Patent
Wiart et al.

(10) Patent No.: US 12,691,358 B2
(45) Date of Patent: Jul. 28, 2026

(54) ADAPTABLE SHIN GUARD ASSEMBLY

(71) Applicant: INA INTERNATIONAL LTD., Calgary (CA)

(72) Inventors: Nicole Wiart, Toronto (CA); Chris Snell, Toronto (CA)

(73) Assignee: INA INTERNATIONAL LTD., Calgary (CA)

( * ) Notice: Subject to any disclaimer, the term of this patent is extended or adjusted under 35 U.S.C. 154(b) by 0 days.

(21) Appl. No.: 18/879,498

(22) PCT Filed: Sep. 12, 2022

(86) PCT No.: PCT/CA2022/051357

§ 371 (c)(1),
(2) Date: Dec. 27, 2024

(87) PCT Pub. No.: WO2024/055092

PCT Pub. Date: Mar. 21, 2024

(65) Prior Publication Data

US 2025/0387690 A1 Dec. 25, 2025

(51) Int. Cl.
*A63B 71/12* (2006.01)

(52) U.S. Cl.
CPC .... *A63B 71/1225* (2013.01); *A63B 2071/125* (2013.01); *A63B 2071/1258* (2013.01); *A63B 2209/10* (2013.01)

(58) Field of Classification Search
CPC ..... A63B 71/1225; A63B 2071/125; A63B 2071/1258; A63B 2209/10; A41D 13/0543; A41D 13/06
See application file for complete search history.

(56) References Cited

U.S. PATENT DOCUMENTS 2,544,065 A * 3/1951 Carr ..... A63B 71/1225 2/22
3,761,960 A 10/1973 Woodcock
5,771,607 A 6/1998 Dean
5,829,055 A 11/1998 Collins et al.
(Continued)

FOREIGN PATENT DOCUMENTS

CA 1056104 6/1979
CA 2350157 12/2002
CA 2772503 10/2012

OTHER PUBLICATIONS

PCT Search Report and Written Opinion prepared for PCT Application No. PCT/CA2022/051357, completed Jun. 1, 2023.

*Primary Examiner* — Aiying Zhao
(74) *Attorney, Agent, or Firm* — Barnes & Thornburg LLP

(57) ABSTRACT

The invention provides a shin guard assembly for a sports player comprising an outer shell: a liner reversibly connected to an interior portion of the outer shell and being positionable in a first position and a second position: and a pocket connected to the interior portion of the outer shell and configured to reversibly receive the lower portion of the liner when the liner is in the first position. Sports players may customize the placement of the bottom of the shin guard liner depending on how they choose to wear their footwear. When a shin guard liner is in the first position. the pocket covers the bottom of the liner thereby reducing abrasion and wear to the top exterior of sports footwear and to the shin guard liner.

13 Claims, 7 Drawing Sheets

(56) References Cited

U.S. PATENT DOCUMENTS

| | | | | |
|---|---|---|---|---|
| 5,926,844 | A * | 7/1999 | Bear | A63B 71/1225 2/22 |
| 2002/0184693 | A1* | 12/2002 | Beland | A63B 71/1225 2/22 |
| 2006/0179551 | A1* | 8/2006 | Vrijburg | A63B 71/1225 2/267 |
| 2012/0240303 | A1* | 9/2012 | Matta | A41D 13/065 2/24 |
| 2012/0255096 | A1* | 10/2012 | Wesley | A63B 71/12 2/22 |
| 2013/0218105 | A1* | 8/2013 | Blumenfeld | A41D 13/0543 604/293 |
| 2013/0305424 | A1* | 11/2013 | Contant | A41D 13/0543 2/22 |
| 2023/0079906 | A1* | 3/2023 | Beland | A63B 71/1225 2/22 |

* cited by examiner

ADAPTABLE SHIN GUARD ASSEMBLY

CROSS-REFERENCE TO RELATED APPLICATION

This is a national stage entry of International Patent Application No. PCT/CA2022/051357, filed Sep. 12, 2022, the disclosure of which is expressly incorporated by reference herein in its entirety.

FIELD OF THE INVENTION

The present invention relates generally to the field of protective sports apparel and more particularly to shin guards for sports players, having a protective pocket for reducing abrasion and related damage to sports footwear by shin guard liners.

BACKGROUND OF THE INVENTION

This invention relates to protective shin guards with an integrated interior pocket which has been configured to protect shin guard liners and sports footwear against wear, while providing comfort and versatility.

In high-impact sports, such as ice hockey, football, lacrosse, and soccer, players have a need for padded protective gear. Shin guards are among the various protective gear that such sports players wear in order to protect their lower legs, including their knees, shins, calves, and ankles. Shin guards are most commonly constructed as a shell with outer shielding or padding, along with an interior liner. In addition to protecting a player's lower leg, it would be beneficial if shin guards could be designed such that the shin guard liners do not rub against or abrade the top of the player's footwear. Over time, the wear and tear on the top of the player's footwear damages the laces and eyelets of the footwear, and generally reduces the longevity of the footwear. Likewise, the footwear also causes mutual wear and tear on the shin guard liner itself.

For example, in ice hockey, many hockey players wear their hockey skates "tongue out" with the shin guard and the shin guard liner being positioned against the player's leg along its length, and behind the top exterior portion of the player's skate, or the skate's "tongue". However, some ice hockey players wear their hockey skates "tongue in" such that the shin guard liner is positioned in front of the top exterior portion of the hockey skate, in direct contact with the skate's tongue. In the "tongue in" position, the shin guard liner may eventually abrade and damage the top exterior portion of the hockey skate, including the laces and eyelets, thereby causing premature wear on the skate. The rubbing of the skate against the shin guard liner as the skater moves also causes wear on the shin guard liner.

Other developers of shin guards, including hockey shin guards, have typically focused on the material of the bottom inner portion of the shin guard liner, selecting a more abrasion-resistant material than the rest of the liner in order to attempt to protect the top of the hockey skate. However, these shin guard liners are often less comfortable against a player's leg if the player wears their skates or footwear "tongue out". In addition, the abrasion-resistant material will generally lack moisture-wicking and odour-control properties.

Therefore, there is a need for protective shin guards for sports players, including hockey players, that reduce the abrasion and damage to the top exterior portion of the player's footwear, such as hockey skates, and similar abrasion and damage to the shin guard liner. Such gear should be convenient to wear and customizable depending on whether the player wears their footwear "tongue in" or "tongue out". It would also be beneficial if the gear provides sweat, moisture, and odour-control properties.

SUMMARY OF THE INVENTION

These needs are addressed by the shin guard of the present invention which includes a user-adjustable interior pocket for reducing the amount of wear on the top of footwear by shin guard liners. The interior pocket is integrated with the shin guard and reversibly receives the bottom portion of the shin guard liner. The present invention provides greater versatility with two configurations which allow a sports player to customize the placement of the shin guard liner depending on their preference for how their footwear is worn. As mentioned earlier, sports players, for example, hockey players, may choose to wear the tongues of their sports footwear flat against the top of their foot such that their shin guards are in front of the top exterior portion of their footwear (i.e., "tongue in") or they may choose to wear the tongues of their footwear in an upward and outward position such that their shin guards are behind the top exterior portion of their footwear (i.e., "tongue out").

In one aspect, a shin guard assembly for a sports player is provided comprising: (a) an outer shell; (b) a liner detachably connected to an interior portion of the outer shell, the liner comprising an upper portion and a lower portion, the lower portion of the liner being positionable in a first position and a second position; and (c) a pocket connected to the interior portion of the outer shell, the pocket configured to reversibly receive the lower portion of the liner when the liner is in the first position.

Preferably, the outer shell comprises an upper portion and a lower portion, which further respectively comprise a knee shield for protecting the knee of the player and a shin shield for protecting the shin and ankle of the player, respectively.

Preferably, the shin guard liner reversibly attaches to the interior surface of the outer shell of the shin guard and is positionable in a first position, in which the lower portion is contained within the interior pocket, and a second position, in which the lower portion lies outside of the interior pocket.

Preferably, the pocket has a horizontal, vertical, or slanted opening configured to reversibly receive all or part of the bottom portion of the shin guard liner when the shin guard liner is in its first position.

In a further aspect, the integrated interior pocket of the shin guard is made of an abrasion-resistant material. The pocket could be made of a polymer, leather, or any fabric that is suitably treated such as with a wax coating in order to render it abrasion-resistant. Preferably, the pocket covers the bottom edge of the shin guard liner when in its first position, which reduces damage to the top of the player's footwear while providing a comfortable fit against the player's leg.

Preferably, the interior surface of the shin guard liner which will contact the skin when worn, comprises a moisture-wicking fabric and at least one area for contacting the skin or clothing of the player to reduce slipping or movement of the liner position during play.

These and other aspects of the invention are described herein by reference to the description and figures as follows.

BRIEF DESCRIPTION OF THE DRAWINGS

The present invention will now be better understood with reference to the description and to the accompanying drawings in which.

In these figures, preferred embodiments of the invention are illustrated by way of examples. It is to be expressly understood that the description and drawings are only for the purpose of illustration and are an aid for understanding. They are not intended to define the limits of the invention. It should be understood that the drawings are not necessarily to scale, and in certain instances details may have been omitted that are not necessary for an understanding of embodiments of the present invention.

DETAILED DESCRIPTION OF THE INVENTION

Referring to these drawings, it will be appreciated that the invention can be implemented in a range of different sports for a range of different sports players. These embodiments are given by way of example only.

Figure 1:
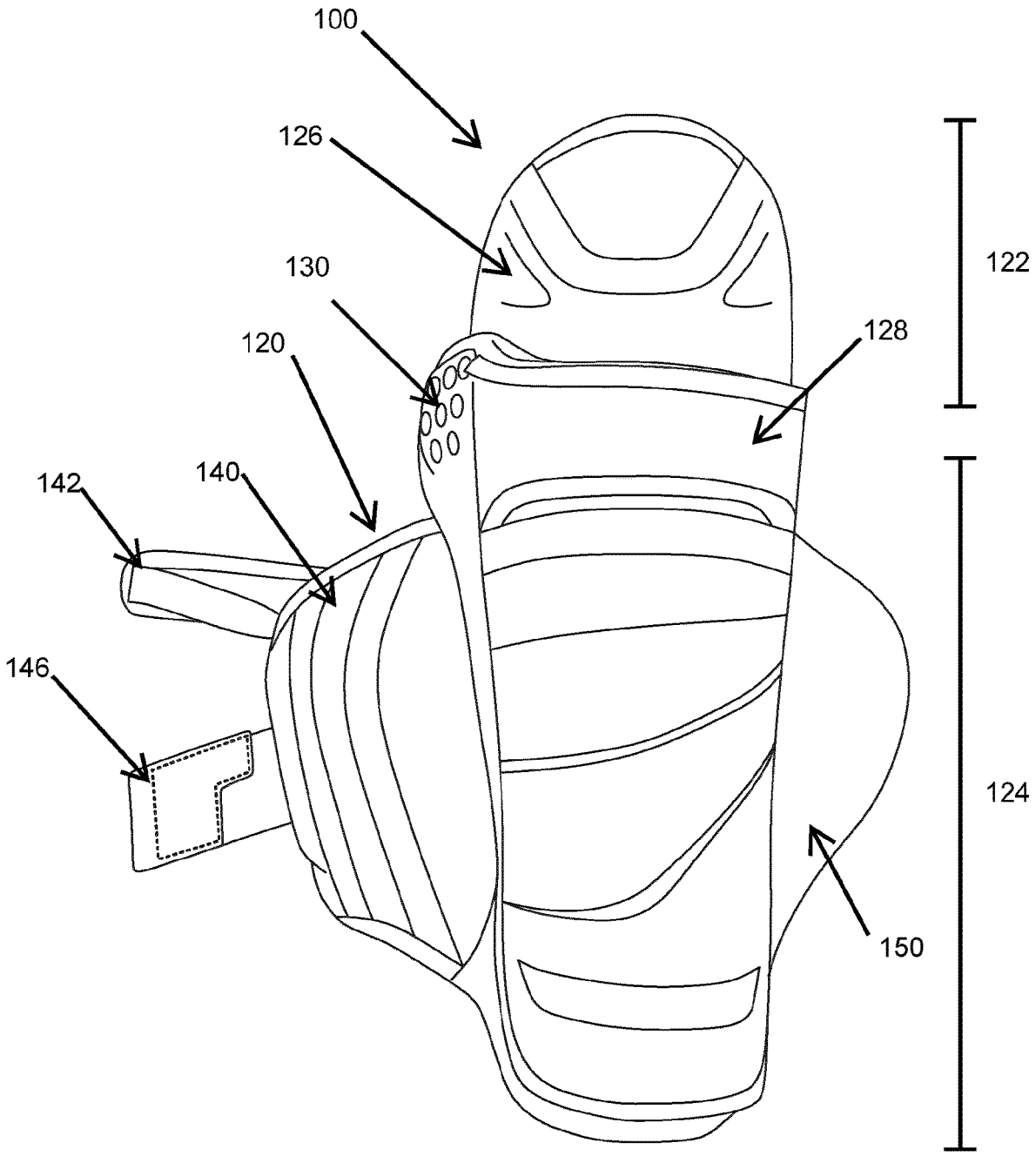
FIG. 1 is a front view of a preferred embodiment of the shin guard including a knee pad, shin pad, and strapping forming part of the outer shell, this embodiment showing the exterior components of the shin guard.

Turning now to the figures, FIG. 1 shows a preferred embodiment of a front view of a shin guard 100 of the invention. In this figure, the shin guard 100 comprises an outer shell 120 with a generally concave structure having a knee portion 122 and a shin portion 124, and a liner 160 and a pocket 180 on its interior side (not visible in this view).

The outer shell 120 has a knee portion 122 and a shin portion 124, a knee shield 126 attached to the knee portion 122 of the outer shell for protecting the knee of a player's leg, and a shin shield 128 attached to the shin portion 124 of the outer shell for protecting the shin and ankle of a player's leg. The knee shield 126 and the shin shield 128 may be moveable relative to one another when the player bends or extends their leg. The knee and shin shields may be removably or permanently attached to knee portion 122 and shin portion 124, respectively, of the outer shell 120.

The knee shield 126 and shin shield 128 may be made of a rigid material protecting the player's leg from impact, for example, impact with a stick, ball, puck, another player, or an inanimate object. The knee and shin shields may be made of polycarbonate materials, thermoplastics, polyethylene, high density polyethylene (HDPE), polypropylene, or any other suitable material. The knee shield 126 and shin shield 128 may be made of the same materials or different materials, and each may comprise a combination of materials. The knee shield 126 and shin shield 128 may alternatively be made of a flexible material capable of protecting the player's leg from impact. Such flexible and protective materials are known in the art.

Figure 5:
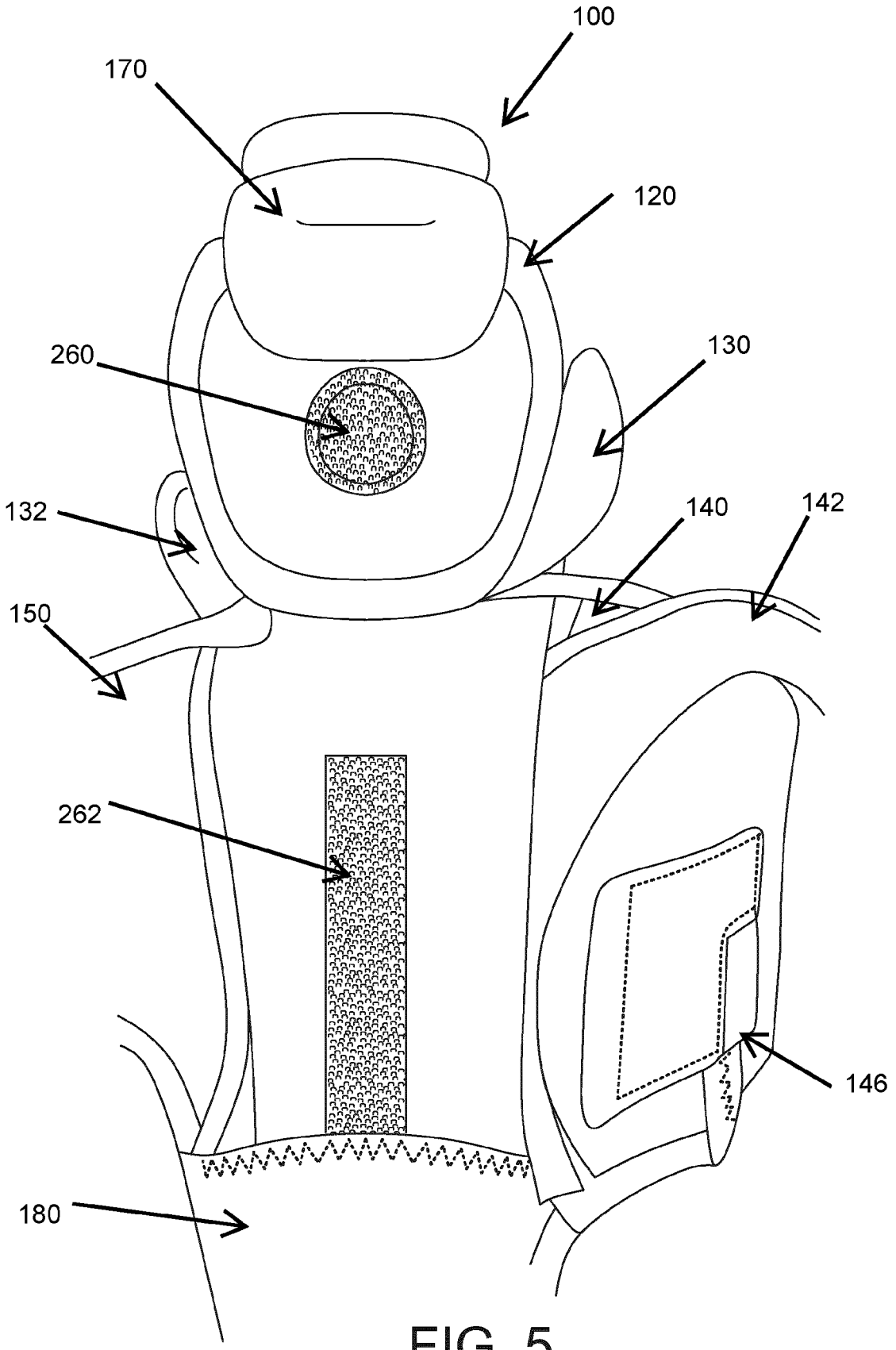
FIG. 5 is a partial back view of an embodiment of the shin guard alone, with the shin guard liner removed.

The shin shield 128 further comprises a first side shield 130 and a second side shield 132 extending from the top portion of the shin shield 128, as can be seen in FIG. 5. The side shields provide additional protection for the sides of the player's knee from impact. The first side shield 130 may be larger than the second side shield 132 to provide greater protection to the exterior side surface of the player's knee.

Figure 6:
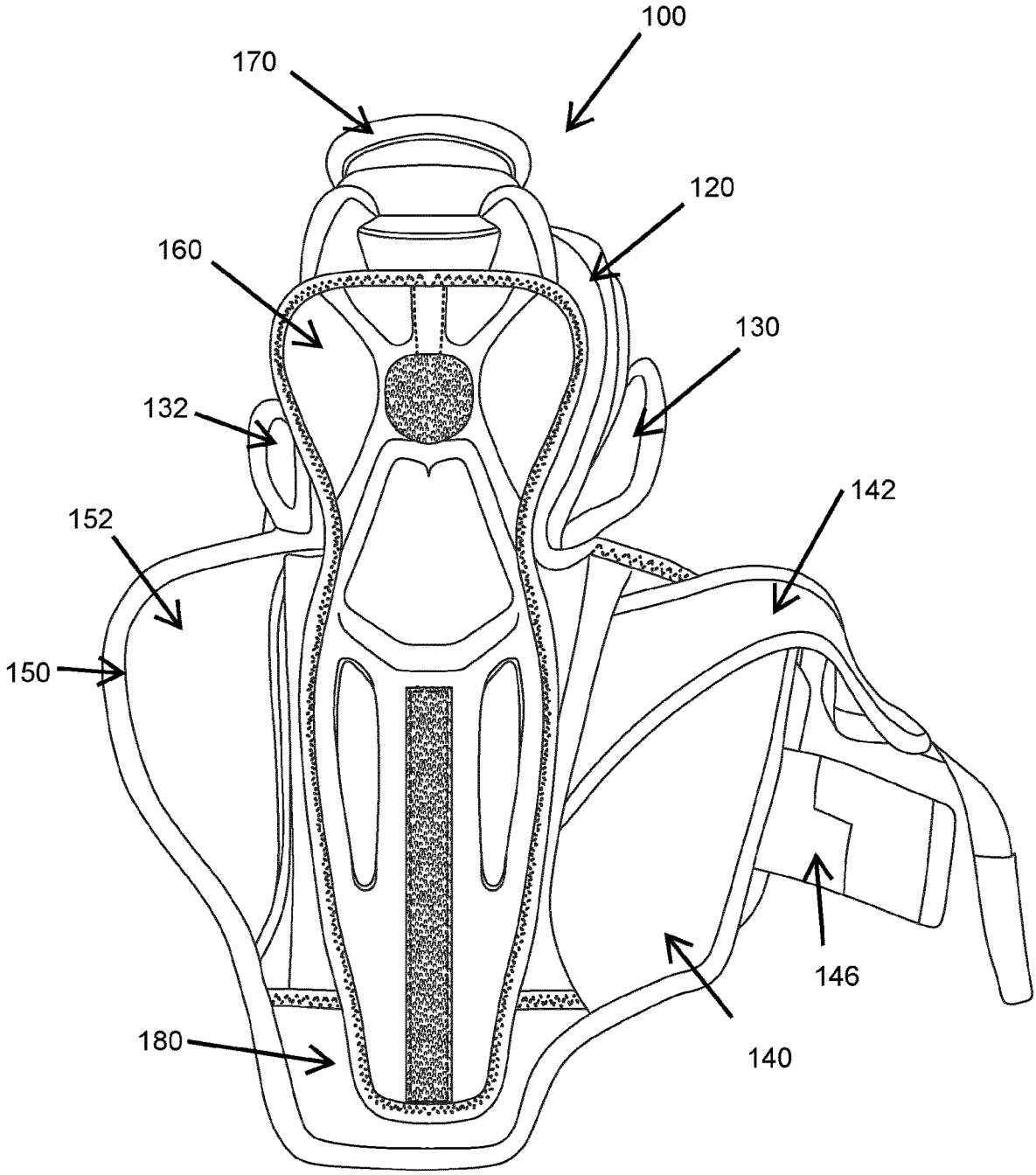
FIG. 6 is a back view of an alternate embodiment of the shin guard, this embodiment showing the shin guard liner installed so that its bottom is located outside of the integrated interior pocket.
Figure 7:
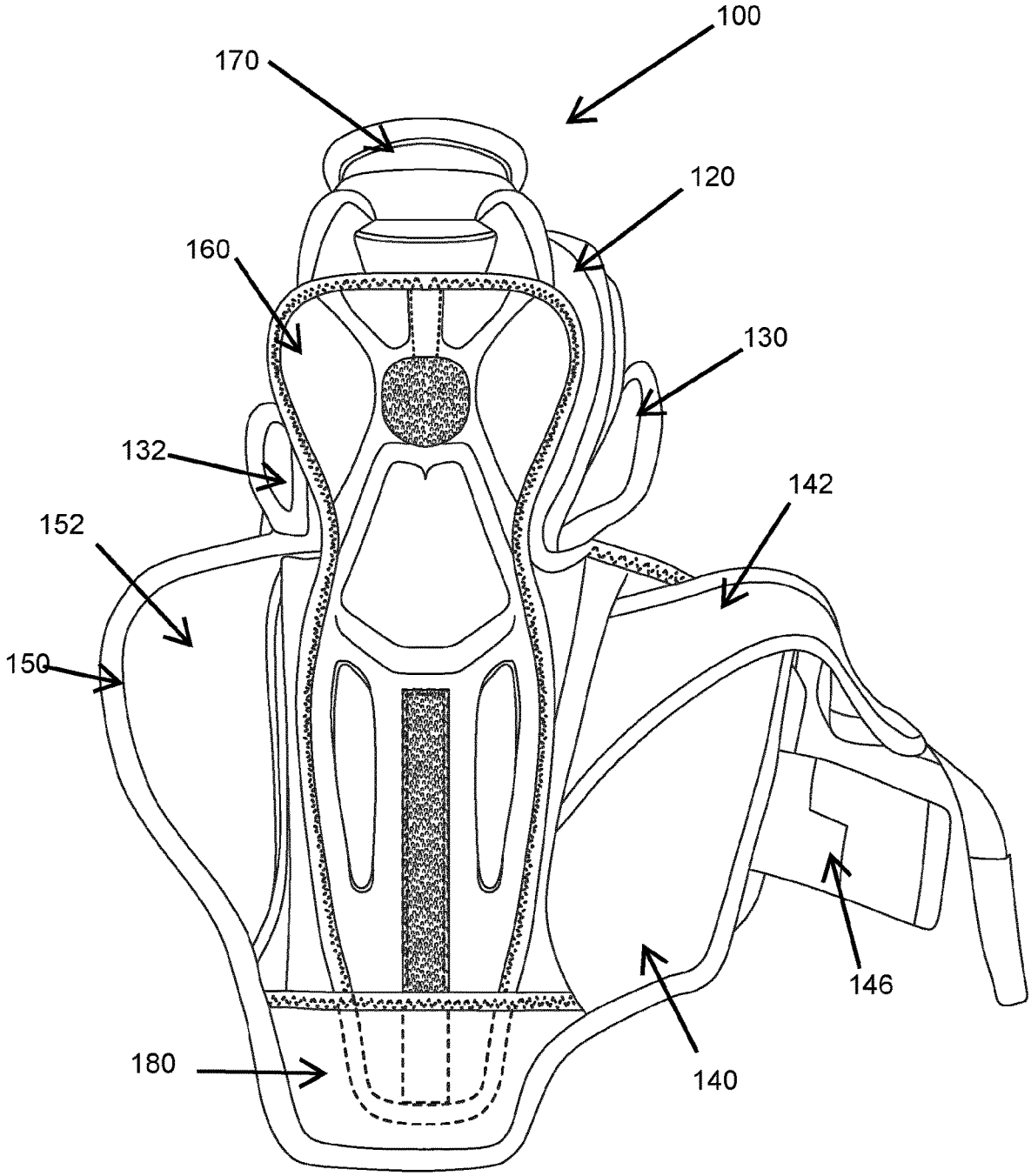
FIG. 7 is a back view of an alternate embodiment of the shin guard, this embodiment showing the shin guard liner inserted into the integrated interior pocket.

The outer shell 120 has a first side flap 140 and a second side flap 150 which surround and provide additional protection for the sides of the player's leg that are not substantially covered by the knee shield 126 and shin shield 128. The second side flap 150 has an interior portion 152, as can be seen in FIG. 6 and FIG. 7 that may incorporate padding comprising sponge foam, low or high density polypropylene foam, or similar materials. The interior portion 152 of the second flap 150 containing the padding may be made of any suitable fabric, most preferably a moisture-wicking fabric, and optionally a stretchable or compression material, such fabrics optionally containing spandex fibres or LYCRA™. The first side flap 140 may optionally also comprise an interior portion containing additional padding, if it is desired.

Figure 2:
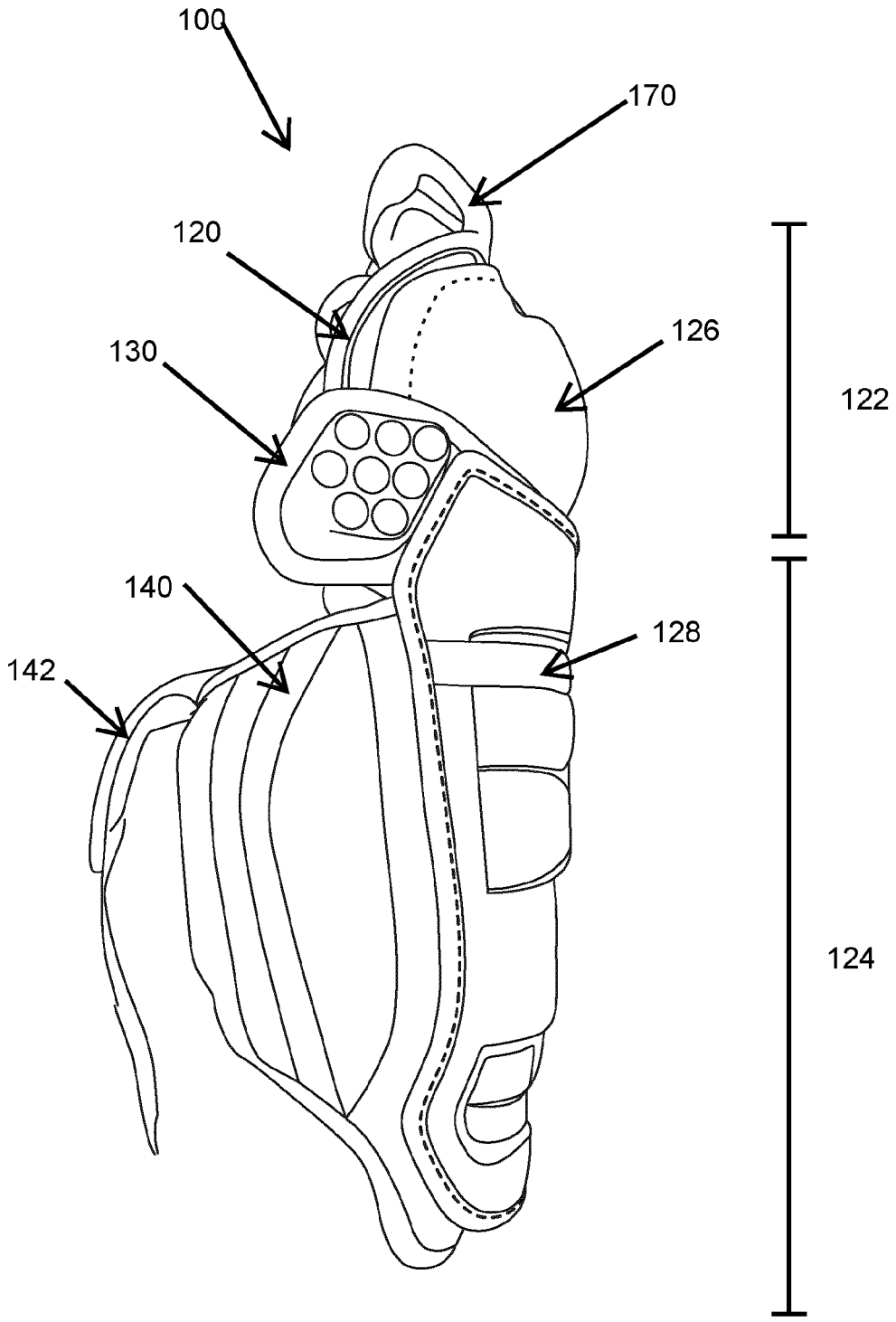
FIG. 2 is a side view of the shin guard of FIG. 1.

FIG. 2 shows a side view of an embodiment of a shin guard 100. In this view, the outer shell 120 has a knee portion 122 and a shin portion 124, a knee shield 126, a shin shield 128, a first side flap 140 and a second side flap 150 (not visible in this view). The first side flap 140 has a shin strap 142 and a calf wrap strap 146 for adjustably mounting and securing the shin pad 100 on the player's leg. The second side flap 150 has a "loop" surface capable of reversibly attaching to opposing complementary "hook" surfaces. The shin strap 142 and the calf wrap strap 146 have "hook" surfaces on their interior faces which extend across their length and reversibly attach by pressure to the opposing "loop" surface on the second side flap 150 allowing the shin pad to be adjustably mounted and secured to the player's leg. The player may tighten the shin strap 142 and/or the calf wrap strap 146 as desired by pulling the straps over the second side flap 150 and applying pressure so that the opposing "hook" and "loop" surfaces may join to form a reversible bond.

The outer shell 120 further comprises a front thigh pad 170 located at the top of the knee portion 122, as shown in FIG. 2 and FIG. 5. The thigh pad 170 provides additional protection to the lower front portion of the player's thigh where it joins their knee. The thigh pad 170 may integrate with the outer shell 120 or may be a reversibly attachable pad that connects to the interior face of the knee portion 122 by, for example, opposing "hook" and "loop" surfaces.

Figure 3:
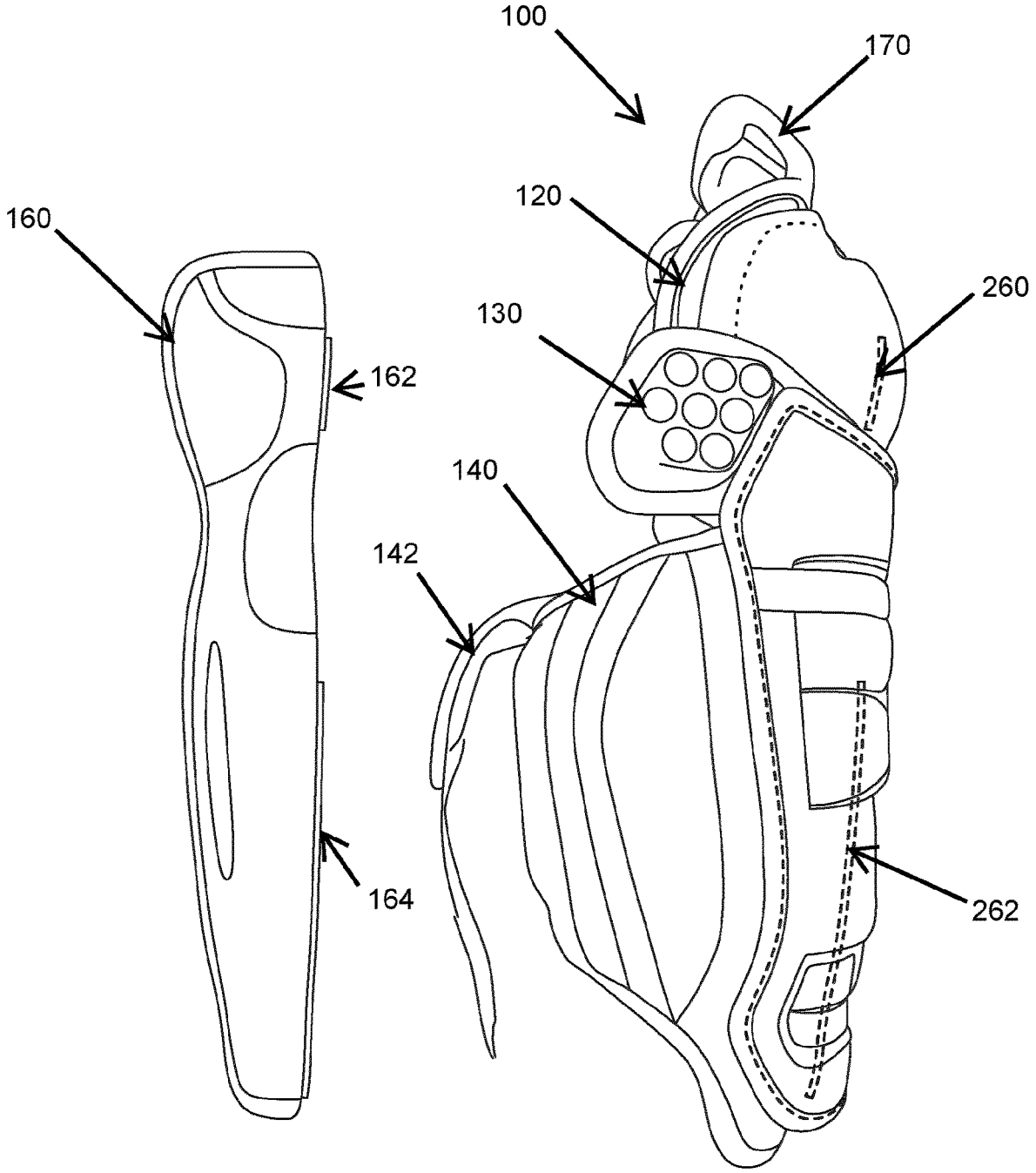
FIG. 3 is a side view of the shin guard of FIG. 1, with a shin guard liner in a side view removed from the interior of the shin guard.

As shown in FIG. 3 and FIG. 5, in a preferred embodiment, the interior surface of the outer shell 120 comprises a first strip 260 and a second strip 262 of "hook" surface, which are capable of reversibly attaching to opposing complementary "loop" surfaces. The first strip 260 is located substantially in the centre of the knee portion 122, while the second strip 262 is an elongated vertical strip located substantially along the centre line of the shin portion 124. Additional strips with other configurations are possible.

Figure 4:
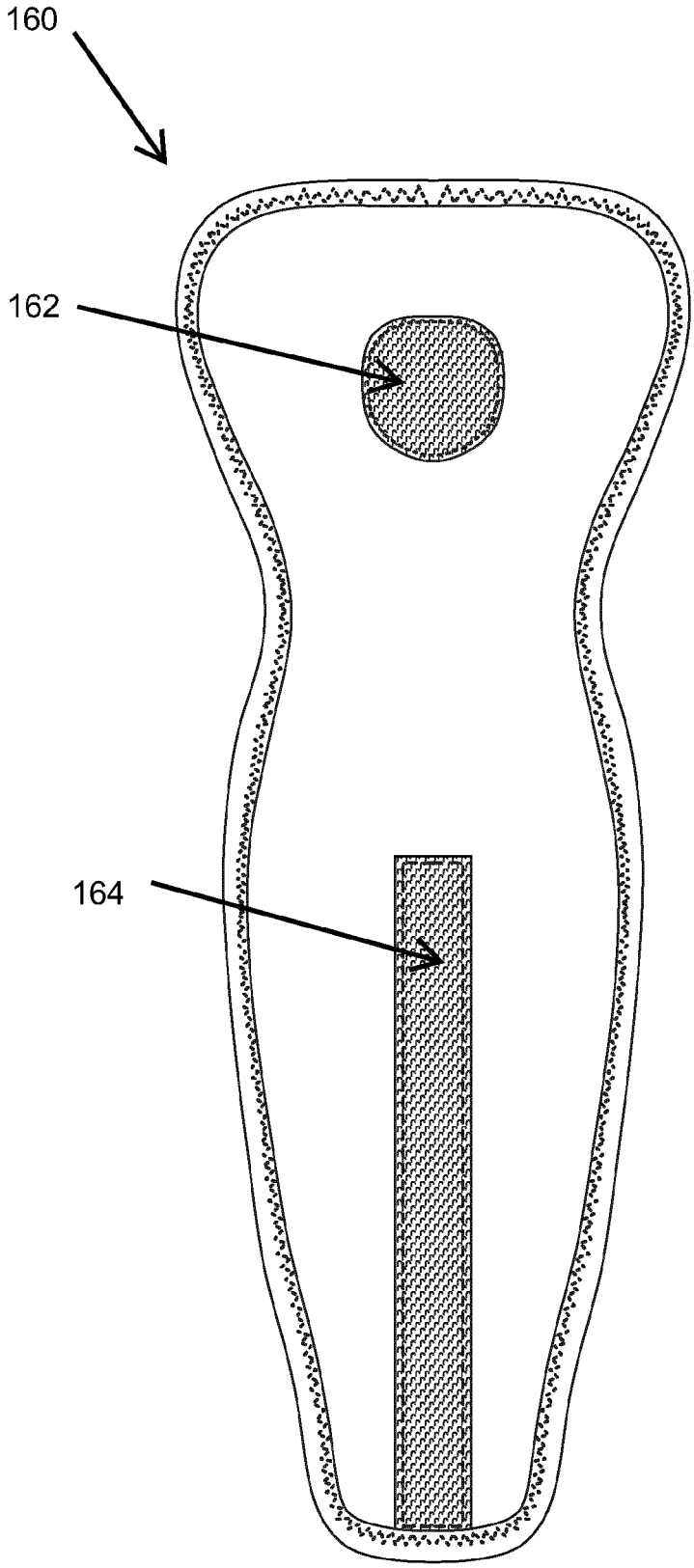
FIG. 4 is a front view of the embodiment of the isolated shin guard liner of FIG. 3.

FIG. 4 shows an embodiment of the liner 160. The liner 160 is a removable insert that is generally concave and of a V-shape such that it conforms to the player's lower leg. As will be further explained below, the liner may be used in a first position and a second position allowing the player to customize its placement depending on how they choose to wear their footwear (i.e., "tongue in" or "tongue out").

Liner 160, as shown in FIG. 3 and FIG. 4, has an interior surface, an exterior surface, and an internal frame (not visible). The exterior surface may be made of any suitable fabric, most preferably a moisture-wicking fabric, and optionally a stretchable or compression material, such fabrics containing spandex fibres or LYCRA™. As can be seen in FIG. 4, the exterior surface of liner 160 also incorporates a first strip 162 and a second strip 164 of "loop" surface which are capable of reversibly attaching to the opposing complementary "hook" surfaces of the first strip 260 and second strip 262, respectively, of the interior surface of the outer shell 120. In this way, the liner 160 may be secured to the interior of the outer shell and positioned so as to block impacts to the front lower leg of the player. Liner 160 can also have only one strip such as strip 164; strip 162 is optional, as is its corresponding mating surface, first strip 260. As long as sufficient gripping surface is provided by such strips, many configurations or shapes for the strips would be available. The exterior surface of the liner 160 is adapted to releasably attach to the interior portion of the outer shell 120 by fastening means, which comprise clips, hook and loop fasteners 162, 164, 260, 262, or snap fasteners.

In FIGS. 6 and 7, liner 160 is seen in a cutaway view so that the surface in contact with the knee shield 126 and shin shield 128 is visible. The interior surface of liner 160, as can be seen in FIG. 6 and FIG. 7, comprises padding for protecting the lower leg of the player from impact and at least one surface providing some friction so that the liner will not tend to slide or slip against the skin or any inner clothing layers worn by the player. The padding may comprise sponge foam, low or high density polypropylene foam, or similar materials. The padding may be contained within any suitable fabric forming the interior surface of the liner 160, most preferably a moisture-wicking fabric, and optionally a stretchable or compression material, such fabrics containing spandex fibres or LYCRA™. The internal frame of liner 160 may be made of molded polyethylene, another thermosetting plastic, or a similar material, and provides greater structure to the liner and protects the interior surface padding from becoming compressed, bent, floppy, or warped with use.

FIG. 5 shows the interior surface of the outer shell 120 further comprising a pocket 180 that is configured to reversibly receive the lower portion of the liner 160 when the liner is in its first position. While the liner 160 is in its first position, the bottom edge of the liner is covered by the pocket 180 and cannot directly contact other surfaces, including the top exterior of sports footwear. This allows a sports player to comfortably wear the shin guard 100, while preventing abrasion and general wear to the top of their sports footwear by the liner 160. When worn in its first position by a hockey player, i.e. tucked into pocket 180, the shin guard liner will not directly contact the top exterior portion of the player's hockey skate, which helps to prevent premature wear and damage to the skate. Such abrasion and damage to the top exterior portion of the footwear of baseball, ball hockey, field hockey, soccer, and football players, and other sports players who wear shin guards and shin guard liners may also be avoided.

The pocket 180 is formed of abrasion-resistant material. Pocket 180 may optionally also incorporate sweat, odour or moisture control features.

The outer shell 120 may be made of any suitable material (s) including polyethylene, low or high density polyethylene, or sponge foam, or any combination thereof, most preferably a moisture-wicking material such as polyester, polypropylene, nylon, wool, rayon, spandex, acrylic, or bamboo, and optionally an elasticized or compression material, including fabrics containing spandex fibres or LYCRA™. Other options for suitable materials are available and known to the skilled person. Such materials and combinations thereof would allow the outer shell to flexibly conform to the player's leg and may reduce the impact of any blows or collisions to the knee shield or shin shield, or the sides of the player's lower leg.

FIG. 5 and FIG. 7 show a preferred embodiment of the shin pad in which the liner 160 is in its first position and is securely, yet reversibly attached to the outer shell 120, with its bottom inserted into the interior of the pocket 180. The first position is suitable for players who prefer to wear their footwear "tongue in".

FIG. 6 shows a preferred embodiment of the shin pad in which the liner 160 is in its second position. In its second position, the liner 160 is securely, yet reversibly attached to the outer shell 120 with the bottom portion located on the outside of the pocket 180. The second position is suitable for players who prefer to wear their footwear "tongue out".

While the invention has been described with reference to specific embodiments, it will be appreciated that numerous variations, modifications, and embodiments would be evident to a person of skill in the art.

The invention claimed is:

1. A shin guard assembly for a sports player comprising:

an outer shell comprising an upper portion and a lower portion, wherein the upper portion of the outer shell comprises a knee shield for protecting the knee of the sports player and the lower portion of the outer shell comprises a shin shield for protecting the shin and ankle of the sports player;

a liner reversibly connected to an interior portion of the outer shell, the liner comprising an upper portion and a lower portion, the lower portion of the liner being configured to be positionable in a first position and a second position; and a pocket connected to the interior portion of the outer shell, the pocket configured to reversibly receive the lower portion of the liner when the liner is in the first position, in which the knee shield and the shin shield are rigid.

2. The shin guard assembly of claim 1, in which the pocket has a horizontal, a vertical, or a slanted opening configured to reversibly receive the lower portion of the liner when the liner is in the first position.

3. The shin guard assembly of claim 2, in which the pocket is made of an abrasion-resistant material.

4. The shin guard assembly of claim 3, in which said abrasion-resistant material comprises at least one of a plastic, a leather, or a coated fabric.

5. The shin guard assembly of claim 1, in which the liner has an exterior surface and an interior surface.

6. The shin guard assembly of claim 5 in which the exterior surface of the liner is adapted to releasably attach to the interior portion of the outer shell by fastening means.

7. The shin guard assembly of claim 6 in which the fastening means comprise clips, hook and loop fasteners, or snap fasteners.

8. The shin guard assembly of claim 5, in which the interior surface of the liner comprises a moisture-wicking fabric.

9. The shin guard assembly of claim 5, in which the interior surface of the liner comprises at least one area for contacting the skin of the sports player.

10. The shin guard assembly of claim 9 in which the at least one area for contacting the skin of the sports player comprises a slip-resistant material.

11. The shin guard assembly of claim 10 in which the slip-resistant material comprises rubber or silicone.

12. The shin guard assembly of claim 8, in which the moisture-wicking fabric comprises at least one of polyester, polypropylene, nylon, wool, rayon, spandex, acrylic, or bamboo.

13. The shin guard assembly of claim 1, further comprising one or more straps for reversibly attaching the shin guard assembly to the lower leg of the sports player.

* * * * *